US006736536B2

(12) United States Patent
Jacobs et al.

(10) Patent No.: US 6,736,536 B2
(45) Date of Patent: May 18, 2004

(54) APPARATUS AND METHOD FOR MEASURING, MIXING, AND DISPENSING FLUIDS

(75) Inventors: Michael R. Jacobs, Grafton, WI (US); Wilson L. McAlpine, Sheboygan, WI (US)

(73) Assignee: Fullfill, Inc., Sheboygan, WI (US)

( * ) Notice: Subject to any disclaimer, the term of this patent is extended or adjusted under 35 U.S.C. 154(b) by 114 days.

(21) Appl. No.: 10/121,929

(22) Filed: Apr. 12, 2002

(65) Prior Publication Data

US 2003/0192911 A1 Oct. 16, 2003

(51) Int. Cl.[7] ..... B67D 5/60

(52) U.S. Cl. ..... 366/130; 206/221; 215/DIG. 8; 222/145.5

(58) Field of Search ..... 222/129, 145.5, 222/158; 366/130; 206/221; 215/DIG. 8

(56) References Cited

U.S. PATENT DOCUMENTS

| | | | | |
|---|---|---|---|---|
| 2,869,745 A | * | 1/1959 | Lockhart | 206/221 |
| 3,658,204 A | | 4/1972 | Bottger | |
| D236,314 S | | 8/1975 | Sugai | |
| 3,948,105 A | | 4/1976 | Johnson, Jr. | |
| 4,069,835 A | | 1/1978 | Stadler | |
| 4,079,629 A | | 3/1978 | Hope | |
| 4,292,846 A | | 10/1981 | Barnett | |
| 5,123,460 A | | 6/1992 | Reed | |
| 5,295,610 A | | 3/1994 | Levison | |
| 5,447,245 A | | 9/1995 | Merhar | |
| 5,547,109 A | | 8/1996 | Robbins, III | |
| 5,575,354 A | | 11/1996 | Taylor | |
| 5,662,249 A | | 9/1997 | Grosse | |
| 6,022,134 A | | 2/2000 | Andrews | |
| 6,250,154 B1 | | 6/2001 | Cheresko | |

* cited by examiner

*Primary Examiner*—Philippe Derakshani
(74) *Attorney, Agent, or Firm*—Michael Best & Friedrich LLP

(57) ABSTRACT

Some embodiments of the present invention employ a container having first and second chambers for receiving first and second fluids, respectively. Preferably, the first and second chambers are separated by a divider. The divider can be movable, removable, or can otherwise be opened to selectively connect and separate the first and second chambers. In this manner, first and second fluids can be inserted into respective chambers, after which time the divider can be moved to mix the first and second fluids. Preferably, the divider can be positioned to seal one chamber from the other to keep fluids in the chambers separate from one another. The first and second chambers are preferably shaped and sized to enable a user to mix the first and second fluids in a desired mixing ratio by at least partially filling the chambers with the fluids to a common level.

20 Claims, 3 Drawing Sheets

APPARATUS AND METHOD FOR MEASURING, MIXING, AND DISPENSING FLUIDS

FIELD OF THE INVENTION

The present invention relates generally to fluid containers, and more particularly to apparatuses and methods for measuring, mixing, and dispensing fluids.

BACKGROUND OF THE INVENTION

It is common to mix one or more fluids in household, industrial, academic, agricultural, and other applications. For example, common household chemicals including detergents and cleaning solutions, lawn care products, adhesives, and the like must often be combined with water or another fluid before use. As another example, it can be necessary to mix a quantity of gasoline with a quantity of oil to fuel and lubricate a two-cycle internal-combustion engine. As still other examples, some industrial and agricultural chemicals (such as pesticides, fertilizers, solvents, and the like) must be diluted with water or combined with another fluid prior to use.

Often it is necessary or desirable to mix two fluids in specific ratios by volume (referred to hereafter as the "mixing ratios"). For example, agricultural and industrial chemicals are often shipped and/or stored in two or more separate containers and must be combined in a proper mixing ratio before use. Similarly, oil is commonly mixed with gasoline for fueling and lubricating internal combustion engines as mentioned above. Additionally, the owner's manual or other directions of many devices instruct the user to mix different fluids in a particular mixing ratio. In these and other cases, it is desirable and often necessary that the fluids be mixed in specific mixing ratios.

Referring again to internal-combustion engines, if too much oil is added to a given quantity of gasoline, the resultant mix can be too rich for a particular engine. As a result, the engine may not operate at optimal performance levels. Alternatively, if too little oil is added to the gasoline, the engine may not operate properly and may even be damaged as a result of inadequate lubrication. In other applications, cleaning chemicals, pesticides, agricultural products, lawn-care products, and the like are commonly mixed with water in specific ratios before being used. Generally, the inclusion of either too much or too little water can reduce the effectiveness of these chemicals. Therefore, a need exists for an apparatus and a method for accurately combining two or more fluids in desired ratios.

Often, the process of mixing fluids is complicated by the use of two or more different volume measurements, sometimes requiring cumbersome and time consuming conversion calculations. For example, if a first fluid is purchased or made available in measurements of ounces while a second fluid is purchased or made available in measurements of gallons, preparing a proper mixing ratio of these fluids can prove to be difficult for many users. Alternatively, one fluid can be sold or dispensed by the cup while another fluid can be sold or dispensed by the quart. In these and other cases, the user must determine the proper mixing ratio and perform conversion calculations before mixing the first and second fluids. Similarly, the use of different measurement systems (e.g., English vs. Metric measuring systems) can further complicate mixing operations. For example, mixing instructions can be provided in one measurement system despite the fact that they are available for purchase or dispense only in another measurement system's amounts. A need therefore exists for an apparatus and a method which alleviates the need to perform conversion calculations when mixing fluids.

Commonly, a user is directed to mix two or more fluids in specific quantities, but has less than the necessary quantity of one or more of the fluids. For example, a user may be directed to mix four ounces of motor oil with each gallon of gasoline. If the user has less than four ounces of motor oil, the mixing operation can be inconvenient and complicated, such as when the user has an unknown amount of motor oil or is only able to estimate the amount of motor oil available. Additionally, if the user has less than the prescribed amount of one or more fluids, the user may be required to perform multiple calculations, purchase more of one or more of the fluids, and/or waste a quantity of one or more of the fluids. A need therefor exists for an apparatus and a method for mixing fluids in desired ratios, even when the user has less than the prescribed amount of one or more of the fluids or has an unknown amount of one or more of the fluids.

Different applications often require different fluid mixing ratios. For example, a homeowner may have a lawnmower which requires a gasoline/oil mixture in a ratio of 32:1 and may also have a leaf blower which requires a gasoline/oil mixture in a ratio of 64:1. In such cases, it is common to have two separate dedicated fuel containers: one for the lawnmower and one for the leaf blower. This practice of keeping dedicated containers for various devices or applications wastes space, can result in the disposal and waste of fluids that have been mixed but have a limited shelf life, and can cause confusion regarding which mixed fluids are to be used for which devices or applications. It is therefore desirable to provide an apparatus and method for mixing fluids in more than one known ratio.

Frequently, instructions for mixing fluids in a given ratio are directed to relatively large quantities of fluids. For example, an owner's manual may include directions for mixing one gallon of mixed product. In some applications however, it is desirable to prepare less than the amount described in the directions. For example, the user may have less than the prescribed amount of one or more of the fluids (as discussed above) or the user may not need the prescribed amount of mixed product. In such cases, it may still be desirable to mix the two fluids in the prescribed ratios and to mix less than the prescribed amount of mixed product. For example, the user may have a chainsaw with a mixing ratio of 1 part oil to 64 parts gasoline, may only have two-fifths of a gallon of gasoline, and may want to mix an appropriate amount of oil with the gasoline. Alternatively, the chainsaw may only hold half of a gallon of fuel-oil mix and the user may only want to mix enough gasoline and oil to fill the chainsaw. In other applications, the instructions may indicate how to prepare a relatively small amount of fuel-oil mixture, but the user may want to prepare a much larger volume of fuel-oil mixture. A need therefore exists for an apparatus and method for converting fluid mixing ratios into either smaller or larger mixed fluid amounts.

In addition to the design considerations discussed above, apparatuses that are easy to manufacture, easy to assemble, and inexpensive are highly desirable for obvious reasons. In light of the problems and limitations discussed above, a need exists for a fluid mixing apparatus and method which facilitates the accurate combination of two or more fluids in desired mixing ratios, alleviates or reduces the need to perform conversion calculations when mixing fluids, facilitates mixing of two or more fluids according to specified mixing ratios even when the user has less than the prescribed amounts of one or more of the fluids, can facilitate the mixture of two or more fluids in more than one mixing ratio, and can enable the preparation of larger or smaller amounts of fluids having desired fluid mixing ratios. Each preferred embodiment of the present invention achieves one or more of these results.

SUMMARY OF THE INVENTION

Various embodiments of the present invention employ a number of features addressing problems encountered in fluid mixing operations. The present invention provides a fluid mixing apparatus in which two or more fluids can be mixed in one or more desired ratios. In some embodiments, the fluid mixing apparatus of the present invention includes a container having a first chamber and a second chamber for receiving a first and a second fluid, respectively.

Preferably, the first and second chambers are separated by a divider. In some embodiments, the divider is moveable to selectively connect and separate the first and second chambers. In this manner, a first fluid can be inserted into the first chamber, a second fluid can be inserted into the second chamber, and the divider can be moved to mix the first and second fluids. Preferably, the divider can be positioned to seal one chamber from the other to keep fluids in the chambers separate from one another.

In some embodiments, the first and second chambers are adjacent to one another, with the bottom of the first chamber at the same elevation as the bottom of the second chamber. The first and second chambers can be contoured or can otherwise have respective shapes and sizes enabling a user to mix the first and second fluids in a desired mixing ratio by at least partially filling the first chamber with the first fluid to a given elevation measured from the bottom of the first chamber and by at least partially filling the second chamber with the second fluid to the same elevation measured from the bottom of the second chamber. In this manner, the user can accurately mix the first and second fluids in the desired mixing ratio. Additionally, in these and in other embodiments, the user can combine the first and second fluids without performing complicated measuring operations and without performing complicated conversion calculations.

Some embodiments of the present invention have two or more dividers which can be inserted or otherwise positioned in the fluid mixing apparatus or are shaped to define different first and/or second chambers sizes. For example, different dividers can be shaped to occupy different amounts of either or both first and second chambers to change the volume of either or both first and second chambers. As another example, one or more dividers can be inserted or otherwise positioned in different manners to define different fluid chamber sizes. In such manners, dividers can be used to change the ratio of the volumes of the first and second chambers. Therefore, some embodiments of the present invention enable a user to mix fluids in two or more different mixing ratios by the position, shape, or position and shape of a divider between the fluids. Preferably, these embodiments enable a user to mix the first and second fluids in the desired mixing ratio even when the user has less then a specific amount of either or both of the first and second fluids. Additionally, the present invention preferably enables a user to quickly and easily produce the maximum possible amount of mixed product given an available amount of the first and second fluids.

In some embodiments, the fluid mixing apparatus of the present invention can include one or more volume indicators which can display to a user the relative volume of fluid in either or both of two fluid chambers. The fluid indicators can take a number of different forms, including floats, display tubes, and the like. In other cases, the outer wall or at least a portion of the outer wall of the first and second chambers is transparent, semitransparent, or translucent. In such manners, the user can preferably see how full or how empty the first and second chambers are. In these and other embodiments, the first and/or second chambers can have scales that are externally visible to a user, thereby enabling the user to accurately mix desired amounts of the first and second fluids in a desired mixing ratio by filling the first and second chambers to indicia on the scale(s).

Other features and advantages of the present invention along with the organization and manner of operation thereof will become apparent to those skilled in the art upon review of the following detailed description, claims, and drawings, wherein like elements have like numerals throughout.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION

The term "fluid" is used herein and in the appended claims, and is intended to include any substance that is a liquid, gas, or other flowable substance. The term "fluid" therefore includes any solid in flowable form, such as granular or powder material. Also, as used herein and in the appended claims, the term "fluid" includes a mixture of one or more substances in the same or different forms, such as a mixture of liquids, a mixture of gasses, a liquid and gas mixture, a suspension of solid matter in a liquid, a mixture of flowable solids, and the like.

Additionally, reference is made herein and in the appended claims to "first" and "second" fluids. These terms are used for ease of description only and are not intended as a limitation upon the present invention and are not intended to imply relative importance or quantities of the fluids discussed. Additionally, while the following description frequently refers to a first fluid and a second fluid, it is contemplated that the present invention can also be used to mix three or more fluids.

Also, in the following description, reference is frequently made to mixing oil and gasoline for use in internal-combustion engines. The combination of oil and gasoline for use in internal-combustion engines is used as an example and is not intended as a limitation upon the present invention. It is contemplated that the present invention can also be used to mix, store, and dispense other fluid mixtures. For example, the fluid mixing apparatus of the present invention can be used with household chemicals, including detergents, lawn-care products, cleaning solutions, adhesives, and the like, industrial and agricultural chemicals such as pesticides, fertilizers, solvents, beverages and other comestible fluids, and the like. Additionally, mixed products generated by or created using the present invention can be used in a number of different applications and operations, including without limitation agricultural applications, industrial applications, laboratory applications, academic and scientific applications, food and beverage preparation, and the like.

Additionally, terms of orientation and relative position (such as "top", "bottom", "up" and "down" and variations thereof) are not intended to require a particular orientation of the present invention or of any element or assembly of the present invention. Such terms are used for purposes of illustration and description only, and are not intended as limitations upon the scope of the present invention.

Figure 1B:
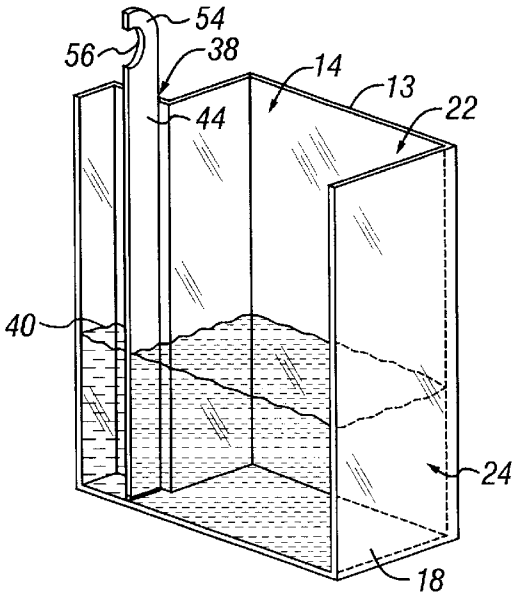
FIG. 1B is a front perspective cross-sectional view of the fluid mixing apparatus shown in FIG. 1A, taken along lines 1B—1B in FIG. 1A.
Figure 1A:
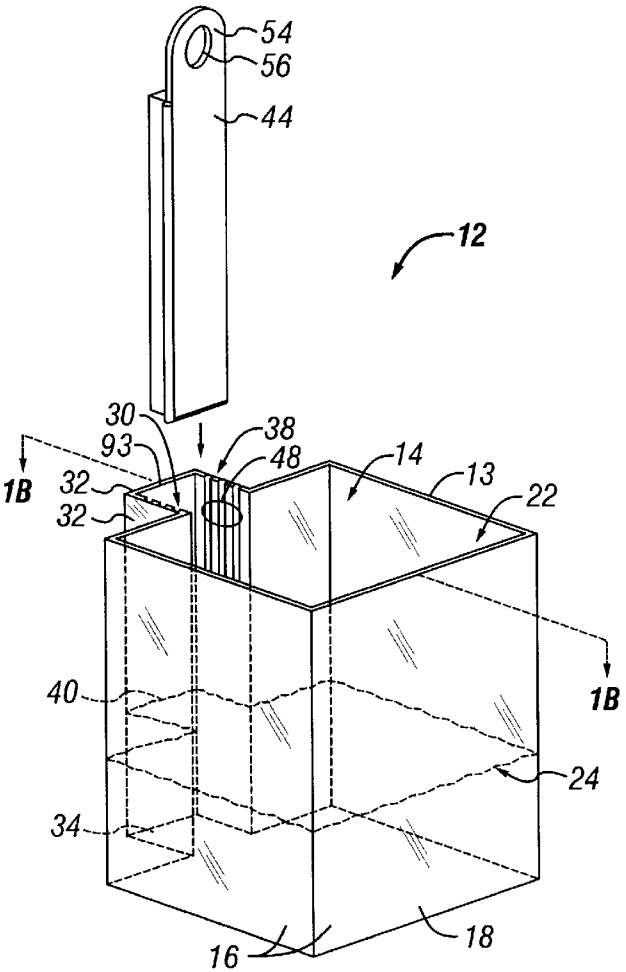
FIG. 1A is a front perspective view of a fluid mixing apparatus according to a preferred embodiment of the present invention.
Figure 2A:
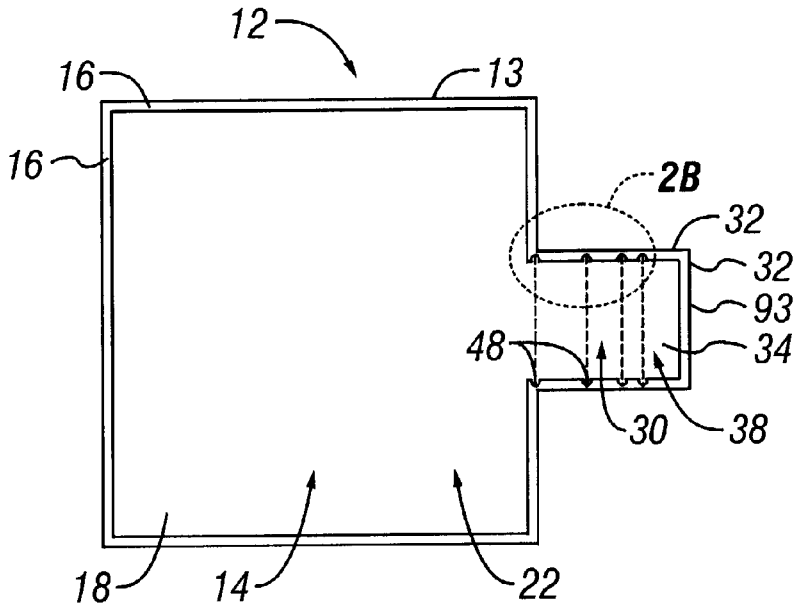
FIG. 2A is a top view of the fluid mixing apparatus illustrated in FIG. 1A.
Figure 2B:
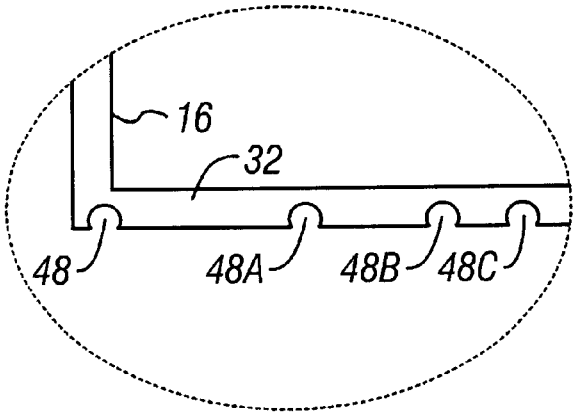
FIG. 2B is a detail view of FIG. 2A.
Figures 3A, 3B, 3C, 3D, 3E:
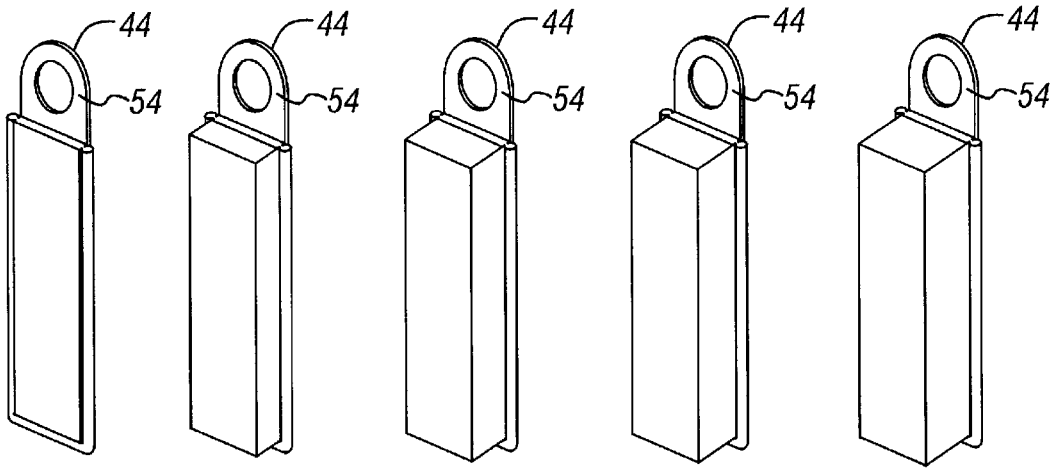
FIGS. 3A–3E are perspective views of different dividers of the fluid mixing apparatus illustrated in FIGS. 1A and 2A.

Referring first to FIGS. 1A and 1B, the fluid-mixing apparatus 12 of the present invention preferably includes a container 13. In the embodiment shown in FIGS. 1A–2B, the container 13 includes a first chamber 14 and a second chamber 30. The first chamber 14 is preferably at least partially defined by at least one sidewall 16 and a bottom 18, and in some embodiments has a top (not shown) at least partially covering the first chamber 14. In the illustrated preferred embodiment, the first chamber 14 has a rectangular cross section defined at least partially by a number of sidewalls 16. Alternatively, the first chamber 14 can have any other cross-sectional shape, including without limitation round, oblong, and oval shapes, triangular, square, and other polygonal shapes, irregular shapes, and the like. For example, the first chamber 14 can have an irregular shape in the case of containers that are stylized such as the embodiment of the present invention shown in FIG. 4. The first chamber 14 can have any other shape capable of containing or dispensing fluids.

The sidewall(s) 16, bottom 18, and top (if employed) of the first chamber 14 at least partially define a first volume 22. The first chamber 14 is capable of receiving and containing a first fluid 24. The first volume 22 can be any size desired, and can be larger or smaller as determined by a particular application. By way of example only, the first volume 22 can have a one, two, or five gallon capacity.

Figure 4:
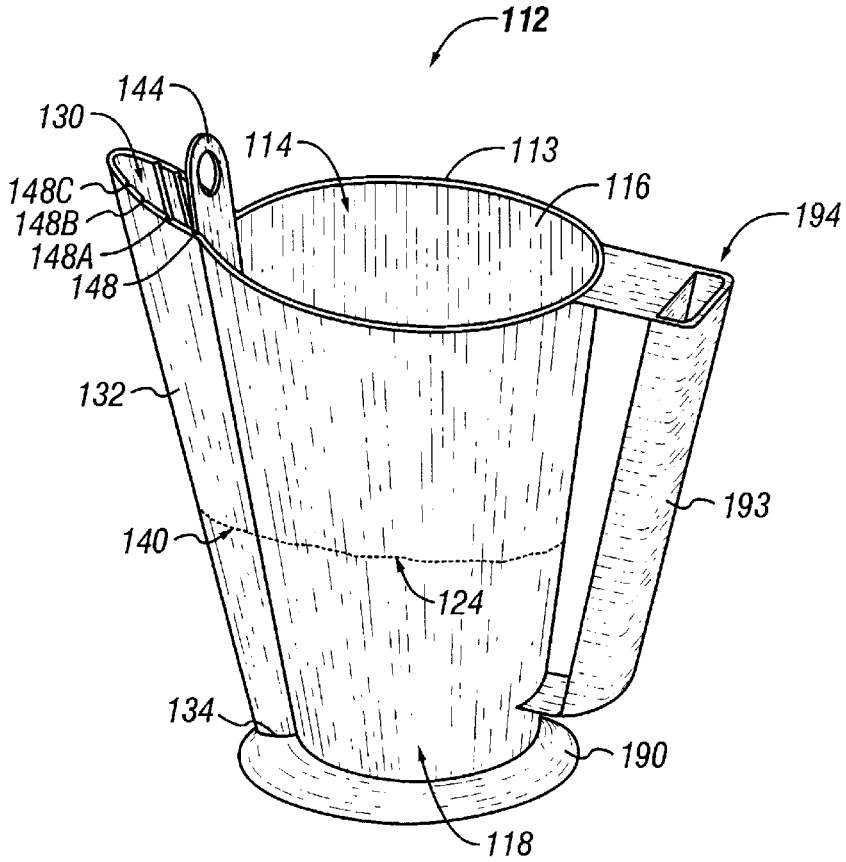
FIG. 4 is a front perspective view of a fluid mixing apparatus according to a second preferred embodiment of the present invention.

With continued reference to FIGS. 1A and 4, the second chamber 30 is preferably at least partially defined by at least one sidewall 32 and a bottom 34, and in some embodiments has a top (not shown) at least partially covering the second chamber 30. The second chamber 30 in the illustrated preferred embodiment has a rectangular cross section defined at least partially by a number of sidewalls 32, but can instead have any cross-sectional shape desired, including those mentioned above with respect to the first chamber 14. In some preferred embodiments for example, the second chamber 30 has an irregular shape at least partially defining a stylized design of the apparatus 12, and can compliment or match the shape of any portion of the first chamber sidewalls 16. Like the first chamber 14, the second chamber 30 can have any other shape capable of containing or dispensing fluids.

The sidewall(s) 32, bottom 34, and top (if employed) of the second chamber 30 at least partially define a second volume 38. The second volume 38 is capable of receiving and containing a second fluid 40. The second volume 38 can be any size desired as determined by a particular application. Preferably, the second volume 38 is smaller than the volume 22 of the first chamber 14, and in some cases can be significantly smaller than the volume 22 of the first chamber 14. The relative sizes of the first and second volumes 24, 40 are preferably determined at least in part by the particular application(s) for which the fluid mixing apparatus 12 is intended. Additionally, in some embodiments of the present invention, the size of either or both first and second volumes 22, 40 can be changed as will be described in greater detail below.

The first and second chambers 14, 30 are preferably made of plastic material. However, in other embodiments, the first and second chambers 14, 30 can be made of a number of other materials such as steel, aluminum, iron, copper, and other metals, glass, ceramics, fiberglass, composite materials, and the like. In some embodiments, the material of the first and second chambers 14, 30 is selected to be durable, corrosion-resistant (at least for those fluids intended to be mixed in the apparatus 12), low-cost, and easy to mold, machine, or otherwise manufacture. If desired, the sidewalls, bottoms, tops, and other elements defining the first and second chambers 14, 30 can be made from different materials, such as metal first chamber sidewalls 16 and bottom 18 and plastic second chamber sidewalls 32 and bottom 34, plastic first chamber sidewalls 16 and bottom 18 and glass second chamber sidewalls 32 and bottom 34, and the like.

The first and second chambers 14, 30 can be defined by any number of sidewalls 16, 32, some of which can define part of both chambers 14, 30 (e.g., wall(s) common to both chambers 14, 30). One or more of the sidewalls 16, 32 and bottoms 18, 34 of the first and second chambers can be shared by both chambers 14, 30. Also, the sidewalls 16, 32 and bottoms 18, 34 can be connected to each other or can be integral with one another as desired. In the embodiments shown in FIGS. 1A–2B, and 4 for example, the container 13, 113 includes first and second chambers 14, 114, 30, 130 which are preferably formed together as a single integral element. In this manner, some of the walls 16, 32, 116, 132 of the first and second chambers 14, 114, 30, 130 preferably define outer walls 42, 142 of the container 13, 113.

With reference again to the embodiment of the present invention illustrated in FIGS. 1A–3E, some preferred embodiments of the fluid mixing apparatus 12 include at least one divider 44 fluidly separating the first and second chambers 14, 30 from one another. The divider 44 is preferably movably coupled to the side walls 16 of the first chamber 14 and/or the sidewalls 32 of the second chamber 30, and in some embodiments is removably coupled thereto.

The divider 44 can include a handle 54. The divider handle 54 can be a separate element connected to the divider 44 in any manner, or can be integral with the divider 44 as shown in FIGS. 1A, 1B, and 3A–3E. Specifically, the divider handle 54 in the embodiment of FIGS. 1A, 1B, and 3A–3E is a portion of the divider 44 that extends above the tops of the first and second chambers 14, 30. The divider handle 54 can take any shape desired, and in the illustrated preferred embodiment of FIGS. 1A–3E has an opening 56 extending therethrough to better enable a user to grasp the divider 44. In other embodiments, the divider handle 54 can have other shapes and configurations commonly used for handles. For example, the divider handle 54 can have a T-shape (not shown) so that the user can wrap two or more fingers around the divider handle 54. Although a divider 44 extending above or otherwise outside of the chambers 14, 30 is preferred in order to enable a user to operate the divider 44 without inserting his or her hands into the first and second chambers 14, 30, other dividers can be sized to fit within the container 13.

A divider 44 that can be grasped (by a handle 54 or otherwise) is one manner in which the divider 44 can be moved and/or removed by a user in operation of the fluid mixing apparatus 12. In other embodiments, the divider 44 can be spring-loaded to eject partially or fully from the apparatus 12 or to move within the apparatus 12 in order to selectively open and close fluid communication between the first and second chambers 14, 30. Springs or other conventional biasing elements can be attached within the apparatus 12 beneath or beside the divider 44 installed between the chambers 14, 30 and can be positioned to bias the divider 44 toward an open or closed position. In order to retain the divider 44 in position against the biasing force of the spring(s) or other biasing element(s), one or more clips, pins, fingers, or other conventional elements can be attached to the apparatus 12 adjacent to the divider 44 and can be manipulated by a user to release the divider 44. One having ordinary skill in the art will appreciate that other biasing and retaining elements and mechanisms can be employed for biasing and retaining the divider 44 as described above, each one of which falls within the spirit and scope of the present invention.

In the embodiment shown in FIGS. 1A–3E, the divider 44 is slidable along and within divider channels 48 defined in the sidewalls 16 of the first chamber 14 and/or the sidewalls 32 of the second chamber 30. With particular reference to FIGS. 1A–2B, the divider channels 48 are preferably notches, grooves, pairs of ribs, depression, or other elements or features of the sidewalls 16, 32 within which edges of the divider 44 can be received. Alternatively, the divider channels 48 can be formed in elements or structure of the container 13 connected to the sidewalls 16, 32.

The divider 44 is preferable received within the divider channels 48 (or is otherwise positionable within the other elements or features of the sidewalls 16, 32) to define a fluid-tight or substantially fluid-tight seal between the divider 44 and the sidewalls 16, 32, thereby preventing the first fluid 24 from flowing past the divider 44 into the second chamber 30 and to prevent the second fluid 40 from flowing past the divider 44 into the first chamber 14 until a user fluidly connects the first and second chambers 14, 30 by moving or removing the divider 44. In this regard, the divider 44 can have edges that are shaped to mate with the shape of the divider channels 48 (such as a mating tongue and groove shape as best shown in FIGS. 1A–3E). Mating tongue and groove connections can be round in cross section as shown in FIGS. 3A–3E or can have a rectangular, V or U-shaped, or any other cross-sectional shape desired.

In other embodiments, the divider 44 can have a gasket, seal, or other separate element attached thereto to fit the divider channels 48. Alternatively, such an element can be located in one or more of the divider channels 48 to help provide a fluid-tight fit between the first and second chambers 14, 30. Any gasket or seal capable of separating the chambers 14, 30 in such a manner can be employed, and preferably surrounds all portions of the divider 44 that can contact the first or second fluids 24, 40 when the divider 44 is installed. By way of example only, the divider channels 48 in the illustrated preferred embodiment of FIGS. 1A–3E preferably extend down sides of the sidewalls 16 and/or 32 and across a bottom 18 and/or 34 of the container 13.

The illustrated preferred embodiments of the present invention employ a divider that has a sliding seal with walls of the container 13 to selectively separate one fluid 24 from another 40 in the chambers 14, 30. However, one having ordinary skill in the art will appreciate that other types of dividers movable in other manners can be used to perform the same or similar functions. By way of example only, some alternative embodiments can employ a divider 44 that is pivotably about an axis defined by a pivot or hinge connected to a bottom 18, 34 of the container 13 or to one or more sidewalls 16, 32 thereof (e.g., a vertical axis extending between the chambers 14, 30, a vertical axis defined by a hinge connected to sidewalls 16, 32 to enable the divider 44 to open like a hinged door, etc.). In other embodiments, the divider 44 can be a valve that extends through a permanent or movable wall separating the first and second chambers 14, 30. In this manner, the valve can selectively fluidly connect the first and second chambers 14, 30.

In some embodiments, the first and second chambers 14, 30 are two separate containers that are separated by a distance. In such embodiments, the first and second chambers 14, 30 can be fluidly connected by a pipe, a hose, a duct, a tube, or another similar fluid conduit extending through walls 16, 32 of the first and second chambers 14, 30. In these embodiments, the divider 44 can be a valve or another similar member located between the first and second chambers 14, 30 along the fluid conduit to selectively fluidly separate the first and second chambers 14, 30, or can take any of the other forms described above with reference to the illustrated preferred embodiments. In this manner, the divider 44 can preferably be opened to allow at least one of the first and second fluids 24, 40 to flow between the first and second chambers 14, 30. Any type of valve can be employed as a divider 44, including without limitation ball valves, gate valves, needle valves, pinch valves, and the like. The first and second chambers 14, 30 can be separated by any distance desired, enabling the design of either chamber 14, 30 to define a handle for the container 13, any other feature or portion of a stylized container 13, and the like.

Some embodiments of the present invention employ at least one chamber 14, 30 that can be detached from the container 13 and from at least one other chamber 30, 14. In such embodiments, the walls and bottom defining the chambers 30, 14 are preferably sufficient to retain fluid within the chambers 30, 14. The chambers 14, 30 can be detached from one another in a number of different manners, such as by a hook of the second chamber 30 placed over the rim of the first chamber 14, magnet sets releasably connecting the first and second chambers 14, 30, inter-engaging portions of the walls 16, 32 defining the first and second chambers 14, 30, and the like. In these embodiments, the first fluid 24 can be poured into the first chamber 14 and the second fluid 40 can be poured into the second chamber 30. Specifically, once the first and second fluids 24, 40 are placed in their respective first and second chambers 14, 30, the user can preferably separate one chamber 30, 14 from the other chamber 14, 30 to pour the fluid 24, 40 from one chamber 14, 30 into the other chamber 30, 14 and to mix the fluids 24, 40.

As discussed in greater detail above, it is often necessary to mix fluids in specific ratios by volume. For example, when mixing motor oil and gasoline to fuel and lubricate some internal combustion engines, the user may be directed to mix a certain amount of motor oil with a certain amount of gasoline. The user may be directed to mix motor oil and gasoline in a ratio of one part motor oil to thirty-two parts gasoline, one part motor oil to sixty-four parts gasoline, or in still other ratios.

Referring again to the illustrated preferred embodiment of FIGS. 1A–3E, a user desiring to mix the first fluid 24 (e.g., motor oil) with the second fluid 40 (e.g., gasoline) to produce a mixed product preferably introduces the first and second fluids 24, 40 into respective chambers 14, 30 of the container 13 for subsequent mixing by moving or removing the divider 44. To mix the first and second fluids 24, 40 in a desired ratio, the first and second chambers 14, 30 preferably have relative volumes that are the same as the desired mixing ratio. In other words, a mixing ratio R of the first volume 22 to the second volume 38 is preferably equal to the mixing ratio of the desired mixed product. For example, the first volume 24 can be thirty-two times the size of the second volume 38 to produce a mixing ratio R equal to 32:1. In other cases, any mixing ratio R can be produced by employing containers 13 having different relative volumes 22, 38 of the first and second chambers 14, 30. By way of example only, mixing ratio R can be 1:2, 1:3, 2:1, 3:1, 4:1, etc. when containers having relative chamber volumes 22, 38 of 1:2, 1:3, 2:1, 3:1, 4:1, etc. are used.

In cases where the first and second chambers 14, 30 have known volumes, desired mixing ratios can be prepared by filling both containers or by filling each chamber 14, 30 a certain known amount (e.g., half-way, three-quarters, one-third, and the like) prior to mixing. However, significant advantages of the present invention are provided when a known mixing ratio can be produced when both chambers 14, 30 are filled to any point (or at least to any point in a range of fill levels of both chambers 14, 30). In this manner, a number of different quantities of the mixed product having a desired mix ratio can be quickly and easily produced. This capability is enabled in the illustrated preferred embodiments by locating the chambers 14, 30 in side-by-side relationship, whereby the chambers 14, 30 have the same lowest point and have a cross-sectional ratio that is constant or substantially constant along all or at least part of the height of the chambers 14, 30.

For example, in the illustrated preferred embodiments of FIGS. 1A–4, the first and second chambers 14, 114, 30, 130 are adjacent to one another and the bottom 18, 118 of the first chamber 14, 114 is at the same elevation as the bottom 34, 134 of the second chamber 30, 130. Additionally, the first and second chambers 14, 114, 30, 130 are preferably shaped so that the cross-sectional area of the first and second chambers 14, 114, 30, 130 (and therefore the mixing ratio R of the first and second chambers 14, 114, 30, 130) is the same at any given elevation of the first and second chambers 14, 114, 30, 130. Accordingly, if the first chamber 14, 114 is filled with one inch of the first fluid 24, 124 (measured from the bottom 18, 118 of the first chamber 14, 114) and the second chamber 30, 130 is filled with one inch of the second fluid 40, 140 (measured from the bottom 34, 134 of the second chamber 30, 130), the fluid mixing apparatus 12, 112 preferably contains the first and second fluids 24, 124, 40, 140 in the desired mixing ratio R. Similarly, if the first chamber 14, 114 is filled with two inches of the first fluid 24, 124 (measured from the bottom 18, 118 of the first chamber 14, 114) and the second chamber 30, 130 is filled with two inches of the second fluid 40, 140 (measured from the bottom 34, 134 of the second chamber 30, 130), the fluid mixing apparatus 12 preferably contains a greater amount of the first and second fluids 24, 124, 40, 140 in the same desired mixing ratio R.

In this manner, a user can preferably prepare any amount of mixed product, dependant only upon the available supply of the first and/or second fluids 24, 124, 40, 140. For example, if the user needs to mix the first and second fluids 24, 124, 40, 140 in the mixing ratio R when R is equal to 64:1 and the user has 2 gallons of the first fluid 24, 124 and only 0.1 gallons of the second fluid 40, 140, the user can pour all of the second fluid 40, 140 into the second chamber 30, 130 and can fill the first chamber 14, 114 to the same elevation. The user can then move, remove, or otherwise open the divider 44, 144 to establish fluid communication between the first and second chambers 14, 114, 30, 130 in order to mix the fluids 24, 124, 40, 140, or (in other embodiments described above) can disconnect the first and second chambers 14, 114, 30, 130 to pour one of the fluids 24, 124, 40, 140 into the chamber 30, 130, 14, 114 containing the other fluid 40, 140, 24, 124. In this manner, the user can mix a maximum amount or any other desired amount of mixed product at a desired mixing ratio R.

With reference again to the illustrated preferred embodiment of FIGS. 1A–3E, the first and second walls 16, 32 are preferably transparent. Therefore, a user can partially or fully fill one of the first and second chambers 14, 30 to a given elevation and can more easily fill the other of the first and second chambers 30, 14 to the same elevation by visually comparing the height of the first and second fluids 24, 40 in the first and second chambers 14, 30. The use of transparent, semi-transparent, or translucent sidewalls 16, 32 enables a user to easily mix desired amounts of the first and second fluids 24, 40 in the desired mixing ratio R by determining the height of fluid in each of the chambers 14, 30. In other embodiments of the present invention, only part of the chamber walls 16, 32 are transparent, semi-transparent, or translucent to enable a user to determine the level of fluid in the chambers 14, 30. For example, in some cases only one wall 16, 32 or part of a wall 16, 32 of either or both chambers 14, 30 is transparent, semi-transparent, or translucent. In other embodiments, one or more walls 16, 32 of the first and/or second chambers 14, 30 include transparent, semi-transparent, or translucent vertically-extending strips (not shown) enabling a user to determine the level of fluid in the corresponding chamber 14, 30. Therefore, by looking at the strips, a user can compare the elevations of the first and/or second fluids 24, 30 in the chambers 14, 30.

Other types of fluid level indicators can be employed to enable a user to determine the fluid levels in the first and/or second chambers 14, 30. For example, either or both chambers 14, 30 in the illustrated preferred embodiment of FIGS. 1A–3E can have transparent, semi-transparent, or translucent tubes (not shown) in fluid communication with fluid 24, 40 inside the chambers 14, 30. Fluid in the tubes (which are preferably visible from the exterior of the container 13) preferably rises to the level of the fluids within the chambers 14, 30 to enable the user to determine the fluid levels in the chambers 14, 30.

As another example, either or both chambers 14, 30 can each have a conventional float-type fluid level indicator, such as ball floats located within the fluid level tubes described above, a float slidably attached to a wire or other guide member and visible by a user, and the like. Still other types of fluid level indicators and sensors are known to those skilled in the art, and include conventional electronic analog or digital fluid level devices which can be attached to the container 13 and can have a display or other indicator visible from an external location of the container 13.

Although not required to practice the present invention, additional advantages are achieved by using a scale on at least one of the first and second chambers 14, 30 to enable a user to determine the quantity of fluid in the chamber(s) 14, 30. For example, the first chamber 14 in the preferred embodiment illustrated in FIGS. 1A–3E can be provided with a scale (not shown) indicating various volumes within the first chamber 14. The scale is preferably associated with any of the fluid level indicators described above, and thereby enables a user to determine the quantity of fluid 24 in the first chamber 14. In alternative embodiments, the scale can be marked on an inner surface of a wall 16 of the first chamber 14. Still other conventional scales can be employed and would be appreciated by one having ordinary skill in the art. The second chamber 30 can also be provided with a scale that can be of any conventional type, including those described above with regard to the first chamber scale.

In some embodiments of the present invention, the fluid mixing apparatus 12 has a scale (not shown) indicating the combined fluid volume of the container 13 (i.e., the combined occupied volume of the container 13 when both chambers 14, 30 are filled to the same level. This scale is preferably associated with any of the fluid level indicators described above, such as a fluid level indicator for the first chamber 14 or a fluid level indicator for the second chamber 30. With this type of scale, a user can mix a desired mixed quantity of the first and second fluids 24, 40 in the desired mixing ratio R. In still other embodiments, the first and/or second chambers 14, 30 can include other conventional volume displaying apparatuses and mechanisms, each one of which falls within the spirit and scope of the present invention.

In some applications it can be desirable to enable a user to prepare mixtures of fluids (as described above) in two or more different mixing ratios R using the same fluid mixing apparatus 12. Some embodiments of the present invention have this capability by permitting a user to change the volume of the first, second, of first and second chambers 14, 30. In the embodiments of the present invention illustrated in FIGS. 1A–4 for example, the fluid mixing apparatus 12, 112 includes a first divider channel 48, 148, a second divider channel 48A, 148A, a third divider channel 48B, 148B, and a fourth divider channel 148C. For easier user identification of the mixing ratios produced by the divider 44 in each channel 48, 48A, 48B, 48C, 148, 148A, 148B, 148C, the divider channels 48, 48A, 48B, 48C, 148, 148A, 148B, 148C can be labeled with their resulting mixing ratios in any manner desired. By moving the divider 44, 144 between the first, second, and third divider channels 48, 48A, 48B, 48C, 148, 148A, 148B, 148C the user can change the mixing ratio R by changing the volumes of the first and second chambers 14, 30, 114, 130. For example, the mixing ratio of the container 13 in the illustrated preferred embodiment of FIGS. 1A–3E can be 1:16 when the divider 44 is in the first divider channel 48, can be 1:32 when the divider 44 is in the second divider channel 48A, can be 1:64 when the divider 44 is in the third divider channel 48B, and can be 1:128 when the divider 44 is in the fourth divider channel 48C. By locating the divider 44 in different positions between the first and second chambers 14, 30, the relative size (and therefore the resulting mixing ratio) of the first and second chambers 14, 30 can be changed. This can be desirable in many applications, such as when a user wishes to mix oil and gasoline in different ratios for a lawnmower, a leaf-blower, and a snow blower, all of which may have different prescribed mixing ratios R.

Accordingly, some preferred embodiments of the present invention enable the user to insert the divider 44 in different locations between the first and second chambers 14, 30 to produce different mixing ratios R. In other embodiments, the fluid mixing apparatus 12 can include different dividers 44 that occupy different amounts of the first and/or second chambers 14, 30 to generate different mixing ratios R. Examples of such different dividers are illustrated in FIGS. 3A–3E. In operation, a user can remove one divider 44 and can insert another divider 44 having a different shape into the same divider channel 48. In this manner, the user can alter either or both of the first and second volumes 22, 38 and can therefore change the resulting mixing ratio R produced by the apparatus 12. For example, one divider 44A can be used to provide a mixing ratio R of 1:32, while a second divider 44B occupying more of the second chamber 30 than the first divider 44A can be used to provide a mixing ratio R of 1:64. If desired, the different dividers 44 can be labeled to indicate the respective mixing ratios R produced by the apparatus 12 when the different dividers 44 are used. Any number of dividers 44 having any shape (e.g., thickness, length, width, etc.) can be employed to produce any number of different mixing ratios in the same container 13.

In both illustrated preferred embodiments of FIGS. 1A–4, the container 13, 113 has two chambers 14, 30, 114, 130. It should be noted, however, that the container 13, 113 can have any number of different chambers 14, 30, 114, 130 desired. For example, the fluid mixing apparatus 12 in the illustrated preferred embodiment of FIGS. 1A–3E can have a third chamber similar in construction to the second chamber 30 and in selective fluid communication with the first chamber 14 via a movable or removable divider as described above. The third chamber can have the same dimensions and shape as the second chamber in order to enable a user to mix three fluids together using the container 13. In other embodiments however, the volume of the third chamber is different than that of the first and second chambers 14, 30, thereby enabling a user to produce different mixing ratios R by inserting the first fluid 24 into one of the first, second, and third chambers and inserting the second fluid 40 into another of the first, second, and third chambers. When the divider(s) are then moved, removed, or otherwise opened, the fluids 24, 40 are mixed in the desired ratio as described above. In still other embodiments, the fluid mixing apparatus 12 of the present invention can have four, five, or even more chambers arranged in a number of different possible manners.

Some embodiments of the present invention include a handle 193. As shown in FIGS. 1A and 4, the handle 193 can be defined by a chamber or part of a chamber, can be attached to one or more sidewalls 16, 32, 116, 132 of the chambers 14, 30, or can be attached to any other part of the container 13, 113 to enable a user to grasp and carry the apparatus 12, 112. Preferably, the handle 193 is located to facilitate pouring fluid from the fluid mixing apparatus 12, 112. In other embodiments, the fluid mixing apparatus 12, 112 has two or more handles 193.

In embodiments of the present invention having one or more removable dividers 44, 144 as described above, the fluid mixing apparatus 12, 112 can have a divider storage housing 194 (see FIG. 4). The storage housing 194 is preferably a receptacle of the container 113 sized and shaped to receive one or more dividers 144, and can be located in a number of different parts of the apparatus 112. In the illustrated preferred embodiment for example, the storage housing 194 is defined in the handle 193 of the apparatus 112. As another example, the storage housing 194 can be located in a base 190 of the container 113 or in a housing 194 on an exterior side of the container 113. In this manner, a user can insert one or more dividers 144 into the storage housing 194 when the dividers 144 are not being used.

In some embodiments, the fluid mixing apparatus 12 can include a cover (not shown). The cover preferably at least partially encloses the first and second chambers 14, 30, or can at least partially enclose one of the first and second chambers 14, 30. In still other embodiments, the fluid mixing apparatus 12 has two or more covers, such as one cover for each of the first and second chambers 14, 30. The cover(s) can be movable to uncover the chamber(s) of the container 13 by pivoting, sliding, or other motion, and in some embodiments are removable from the container 13. In addition, the cover(s) can include one or more openings for pouring fluid from the container 13, and can be shaped to define a spout for the same purpose. The opening and spout can be defined entirely by the cover(s) or can be defined in part by the cover(s) and in part by the sidewalls 16 of the first chamber 14 and/or the sidewalls 32 of the second chamber 30.

As shown in the embodiment of the present invention illustrated in FIG. 4, the fluid mixing apparatus 112 of the present invention can include a base 190. The base 190 is preferably located adjacent either or both of the first and second chamber bottoms 118, 134. The base 190 can have any shape desired, including an inverted dish shape, a series of legs, and the like.

The embodiments described above and illustrated in the drawings are presented by way of example only and are not intended as a limitation upon the concepts and principles of the present invention. As such, it will be appreciated by one having ordinary skill in the art, that various changes in the elements and their configuration and arrangement are possible without departing from the spirit and scope of the present invention as set forth in the appended claims.

What is claimed is:

1. A fluid mixing apparatus, comprising:

a portable container having a first chamber having a bottom; and a second chamber adjacent to the first chamber, the first and second chambers each having a bottom at a common elevation, the first and second chambers each having a cross-sectional area defined by a horizontal plane passing through the chambers, the cross-sectional area of the first chamber and the cross-sectional area of the second chamber defining a ratio that is substantially constant in a range of different vertical locations in the container; and a divider between the first and second chambers, the divider being movable to open and close fluid communication between the first and second chambers.

2. The fluid mixing apparatus as claimed in claim 1, further comprising a liquid level indicator associated with at least one of the first and second chambers.

3. The fluid mixing apparatus as claimed in claim 1, wherein the divider is positionable and securable in different locations between the first and second containers to define different sizes of at least one of the first and second chambers.

4. The fluid mixing apparatus as claimed in claim 1, wherein the divider is a first divider, the fluid mixing apparatus further comprising at least one additional divider having a different shape than the first divider, the at least one additional divider adapted to be coupled to the container between the first and second chambers and to occupy more space within the first chamber than the first divider, the at least one additional divider movable to open and close fluid communication between the first and second chambers.

5. The fluid mixing apparatus as claimed in claim 1, wherein the divider is slidable with respect to walls within the container and has a sliding seal with the walls within the container.

6. The fluid mixing apparatus as claimed in claim 1, wherein the first chamber at least partially defines a handle of the portable container.

7. The fluid mixing apparatus as claimed in claim 1, wherein the first chamber at least partially defines a spout of the portable container.

8. The fluid mixing apparatus as claimed in claim 1, wherein the first chamber is defined by at least one sidewall, at least part of the sidewall being translucent to enable user identification of a fluid level within the first chamber.

9. An apparatus for mixing a first fluid with a second fluid, the apparatus comprising:

a portable container;

a first chamber within the portable container, the first chamber shaped to hold a quantity of the first fluid;

a second chamber within the portable container, the second chamber shaped to hold a quantity of the second fluid; and at least one wall separating the first and second chambers to prevent fluid flow between the chambers;

wherein the container has a substantially constant ratio of first chamber cross-sectional area to second chamber cross sectional area at different vertical locations in the container; and wherein the first and second chambers are shaped to have a same ratio of fluid capacity at different vertical locations in the container.

10. The apparatus as claimed in claim 9, wherein the at least one wall is movable to establish fluid communication between the first and second chambers.

11. The apparatus as claimed in claim 10, wherein the at least one wall is slidably coupled to at least one wall within the container.

12. The apparatus as claimed in claim 11, wherein the at least one wall is adapted to slidably couple with the at least one wall within the container in different locations between the first and second chambers.

13. The apparatus as claimed in claim 9, further comprising at least one fluid level indicator associated with at least one of the first and second chambers.

14. The apparatus as claimed in claim 9, wherein the first and second chambers are shaped to have the same ratio of fluid capacity at substantially all vertical locations in the container.

15. The apparatus as claimed in claim 10, wherein the at least one wall is removable and replaceable with at least one other wall having a different shape and occupying a different amount of the first chamber.

16. The apparatus as claimed in claim 9, wherein the first and second chambers have respective bottoms at a common elevation.

17. A fluid mixing apparatus for mixing a first fluid with a second fluid, the fluid mixing apparatus comprising:

a portable container at least partially enclosing a volume;

a first chamber within the container;

a second chamber within the container; and a divider coupled to the container and separating the first and second chambers;

each chamber adapted to hold a quantity of fluid, the divider positioned in the container to enable introduction of the first and second fluids into the first and second chambers on opposite sides of the divider, the divider movable from a first position in which the first and second chambers are separated from one another to a second position in which the first and second chambers are in fluid communication with one another to enable mixing of the first and second fluids in the container.

18. The fluid mixing apparatus as claimed in claim 17, wherein the divider is movable between the first and second positions within at least one channel in the container.

19. The fluid mixing apparatus as claimed in claim 17, wherein the divider is removably coupled to the container in a first location and a second location, and wherein the first chamber has a first volume when the divider is in the first location and the first chamber has a second volume when the divider is in the second location, the first volume being greater than the second volume.

20. A method of mixing a first fluid with a second fluid in a container having a first chamber with a first volume and a second chamber with a second volume, the method comprising:

inserting a divider into the container in a first position;

separating the first and second chambers to prevent fluid flow between the first and second chambers;

receiving the first fluid within the first chamber to an elevation;

receiving the second fluid within the second chamber to the elevation; and removing the divider from the container to mix the first fluid and the second fluid together.

* * * * *